US005716248A

United States Patent [19]

Nakamura

[11] Patent Number: 5,716,248

[45] Date of Patent: Feb. 10, 1998

[54] SACRIFICIAL ANODE FOR MARINE PROPULSION UNIT

[75] Inventor: Daisuke Nakamura, Hamamatsu, Japan

[73] Assignee: Sanshin Kogyo Kabushiki Kaisha, Hamamatsu, Japan

[21] Appl. No.: 510,810

[22] Filed: Aug. 3, 1995

[30] Foreign Application Priority Data

Aug. 5, 1994 [JP] Japan ..... 6-204578

[51] Int. Cl.[6] ..... B63H 21/24

[52] U.S. Cl. ..... 440/76; 114/152

[58] Field of Search ..... 440/49, 50, 53, 440/54, 55, 56, 57, 58, 60, 61, 76, 77, 78, 900; 114/152, 282, 285; 204/196, 197

[56] References Cited

U.S. PATENT DOCUMENTS 4,549,949 10/1985 Guinn ..... 440/78

4,604,068 8/1986 Guinn ..... 440/76

4,615,684 10/1986 Kojima ..... 440/88

5,238,433 8/1993 Hayasaka ..... 440/57

5,425,663 6/1995 Meisenburg et al. ..... 440/80

*Primary Examiner*—Stephen Avila

*Attorney, Agent, or Firm*—Knobbe, Martens, Olson & Bear LLP

[57] ABSTRACT

Sacrificial anode arrangements for marine propulsion units wherein the sacrificial anode is juxtaposed to the trim tab and is detachably connected to the lower unit housing by fastening means which can be removed from the upper surface thereof. In one embodiment, the trim tab is detachably connected to the sacrificial anode is connected to the outer housing portion through the sacrificial anode.

17 Claims, 5 Drawing Sheets

SACRIFICIAL ANODE FOR MARINE PROPULSION UNIT

BACKGROUND OF THE INVENTION

This invention relates to a sacrificial anode for a marine propulsion unit and more particularly to an improved and simplified manner of attaching and replacing such sacrificial anodes.

As is well known, the components of marine propulsion units, be they outboard motors or the outboard drive portion of an inboard-outboard drive, frequently are made up of dissimilar metals. These dissimilar metals can come into contact with the water and set up a galvanic action. As is well known, these galvanic actions will cause the metal having the higher activity to corrode or dissolve in the water. The problem is particularly acute in conjunction with propulsion units that are operated in marine or salt water environments.

In order to protect the propulsion unit, it has been the practice to provide a detachable sacrificial anode which is formed from a material that has a higher activity than the other components of the marine propulsion unit which may come into contact with the water. In this way, the sacrificial anode rather than the propulsion unit components will dissolve.

However, the efficiency of the sacrificial anode and its usefulness requires that the sacrificial anode be periodically inspected and replaced when it has dissolved to such an extent that it may no longer be effective. Thus, it has been the practice to mount the sacrificial anode in an area of the propulsion unit where it can be easily viewed and replaced. In fact, it is a normal practice to mount the sacrificial anode either in proximity to or as a part of the trim tab of the marine propulsion unit.

Trim tabs are well known and are utilized to assist in steering and to counter balance the side thrust generated by the propeller. In fact, arrangements have been proposed wherein the trim tab itself functions as the sacrificial anode.

This double utilization has a number of disadvantages. First, it is the normal practice to paint the outer surface of the propulsion unit and particularly the portion which may come into contact with the water. The painting provides protection against corrosion and also provides a better appearance. However, painting of the sacrificial anode renders it incapable of performing its intended purpose.

Also, the mounting of the trim tab and its angle is normally fixed or predetermined by the construction of the outboard motor. If, however, the trim tab forms the anode, then its disassembly and replacement requires subsequent adjustment. Furthermore, as the trim tab dissolves, its effectiveness will degenerate.

In addition to these problems, the trim tab is normally mounted onto the propulsion unit from the underside thereof. This makes it very difficult to replace the trim tab when the propulsion unit is mounted on the hull of the watercraft and when the watercraft is operating in the body of water.

It is, therefore, a principal object of this invention to provide an improved sacrificial anode arrangement for a marine propulsion unit.

It is a further object of this invention to provide an improved mounting arrangement for a marine propulsion unit sacrificial anode that permits the anode to be easily replaced even when the watercraft and propulsion unit are floating in a body of water.

It is a yet further object of this invention to provide an arrangement for mounting the sacrificial anode of an marine propulsion device in such a way that it can be conveniently removed from above.

In connection with the mounting of either the trim tab and/or the sacrificial anode, threaded fasteners are frequently utilized for this purpose. However, if the threaded fastener is exposed, then it can cause undesirable drag and adversely affect the operation of the propulsion unit.

It is, therefore, a still further object of this invention to provide an improved attachment arrangement for a sacrificial anode and/or trim tab wherein the threaded fastener is not exposed in use, but may be easily replaced.

Normally, the lower unit of marine propulsion units are comprised of a two-part construction, the lower of which may be replaceable and used to permit a common casing to be employed for propulsion units having different capacities. That is, the upper or outer drive shaft housing portion may be common for a variety of propulsion units while the lower unit can be replaced to accommodate varying capacities. With this arrangement, the mounting of the trim tab and associated anode structure can present some difficulties.

It is, therefore, a still further object of this invention to provide an improved lower unit construction embodying a trim tab and sacrificial anode wherein replacement and interchangeability is facilitated.

SUMMARY OF THE INVENTION

This invention is adapted to be embodied in a lower unit and sacrificial anode arrangement for a marine propulsion unit. The marine propulsion unit is a comprised of an outer housing portion that operates at least in part below the water level. The outer housing portion provides a trim tab that depends therefrom. A sacrificial anode is juxtaposed to the trim tab. Threaded fastening means accessible from the area of the outer housing portion above the trim tab are provided for detachably connecting at least the sacrificial anode to the outer housing portion.

DETAILED DESCRIPTION OF THE PREFERRED EMBODIMENT OF THE INVENTION

Figure 1:
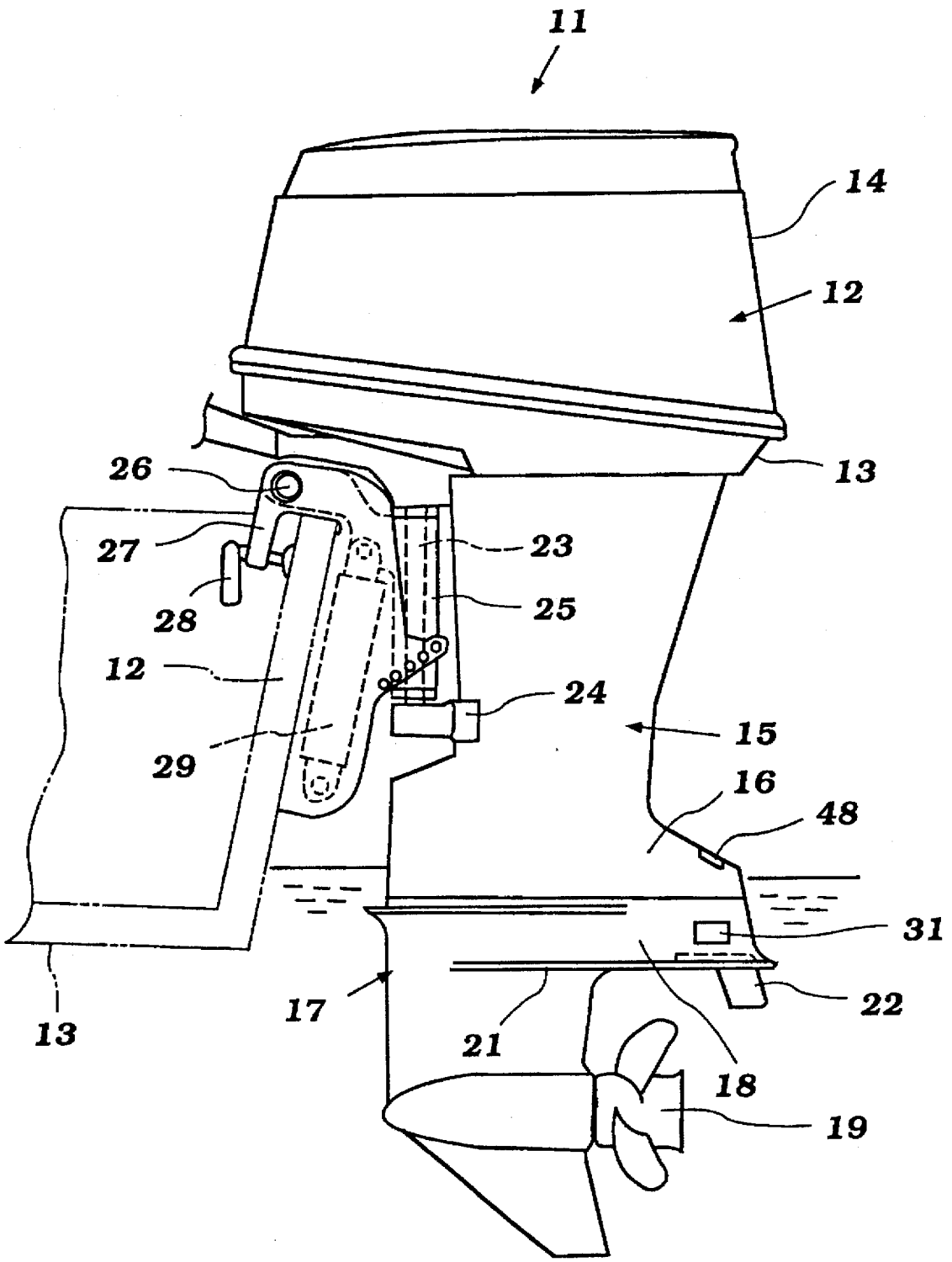
FIG. 1 is a side elevational view of a marine propulsion unit and accompanying watercraft, shown partially and in phantom, constructed in accordance with an embodiment of the invention.

Referring now in detail to the drawings and first to the embodiment of FIGS. 1 through 4 and initially to FIG. 1, an outboard motor constructed in accordance with an embodiment of the invention is identified generally by the reference numeral 11. The outboard motor 11 is attached to a transom 12 of an associated watercraft 13 which are shown partially and in phantom. Although the invention is described in conjunction with an outboard motor, it will be readily apparent to those skilled in the art that the invention may be equally as well practiced with the outboard drive portion of an inboard-outboard drive. Such units are referred to generically as "outboard drives" or "marine" propulsion units in the specification and claims hereof.

As is typical with outboard motors, the outboard motor 11 is comprised of a power head, indicated generally by the reference numeral 12, which is comprised of an outer protective cowling consisting of a lower tray portion 13 and an upper main cowling portion 14. The tray portion 13 may be formed from aluminum or aluminum alloy. The main cover portion 14 is formed from a lighter weight material, such as a molder fiberglass reinforced plastic or the like, and is detachably connected to the tray portion 13 in a known manner.

An internal combustion engine (not shown) is encircled by the protective cowling and completes the power head 12. As is typical with outboard motor practice, the engine is positioned within the protective cowling so that its output shaft rotates about a vertically extending axis. The vertical disposition of the output shaft of the engine of the power head 12 facilitates attachment to a drive shaft (not shown) that depends into and is rotatably journaled within a drive shaft housing, indicated generally by the reference numeral 15. The drive shaft housing 15 includes, among other things, an outer housing 16 which is formed from a casting of a light weight metal, such as aluminum or aluminum alloy.

The afore-noted drive shaft depends into a lower unit, indicated generally by the reference numeral 17 and which has an upper portion 18 that is complementary in shape to the lower portion of the drive shaft housing outer casing 16 and is detachably connected thereto in a manner which will be described. The drive shaft continues into this lower unit casing 17, which may be formed from the same material as the casing 16 of the drive shaft housing 15 and drives a forward, neutral, reverse transmission, of a known type, contained therein. This transmission transfers power to a propeller 19 for propelling the associated watercraft 13.

The lower unit 17 is provided with an anti-cavitation plate 21 that extends generally horizontally and extends rearwardly over the upper portion of the propeller 19. Depending from this cavitation plate 21 is a trim tab 22 which is mounted, in a manner to be described and which functions to counter-balance some of the side thrust generated by the propeller 19 so as to assist in steering, as is well known in this art.

A steering shaft 23 is affixed to the drive shaft housing 15 by means including lower brackets 24 and upper brackets (not shown). This steering shaft 23 is rotatably journaled within a swivel bracket 25 for steering movement of the outboard motor 11 relative to the swivel bracket 25 in a manner well known in this art.

The swivel bracket 25 is, in turn, pivotally connected by means of a pivot pin 26 to a clamping bracket 27. This pivotal connection permits tilt and trim movement of the outboard motor 11 relative to the transom 12 of the associated watercraft. The clamping bracket 27 carries device 28 for detachable connection of the outboard motor 11 to the transom in a manner well known in this art.

The tilt and trim movement may be controlled at least, in part, by a hydraulic cylinder assembly 29 that is interposed between the clamping bracket 27 and the swivel bracket 25.

The foregoing description of the outboard motor 11 has been primarily for the purpose of permitting those skilled in the art to understand the environment in which the invention is practiced. The invention deals with a sacrificial anode assembly, indicated generally by the reference numeral 31, its manner of attachment to the lower unit 17 and replacement and the manner in which the trim tab 22 is affixed to the lower unit 17 and its relationship to the sacrificial anode 31.

Figure 3:
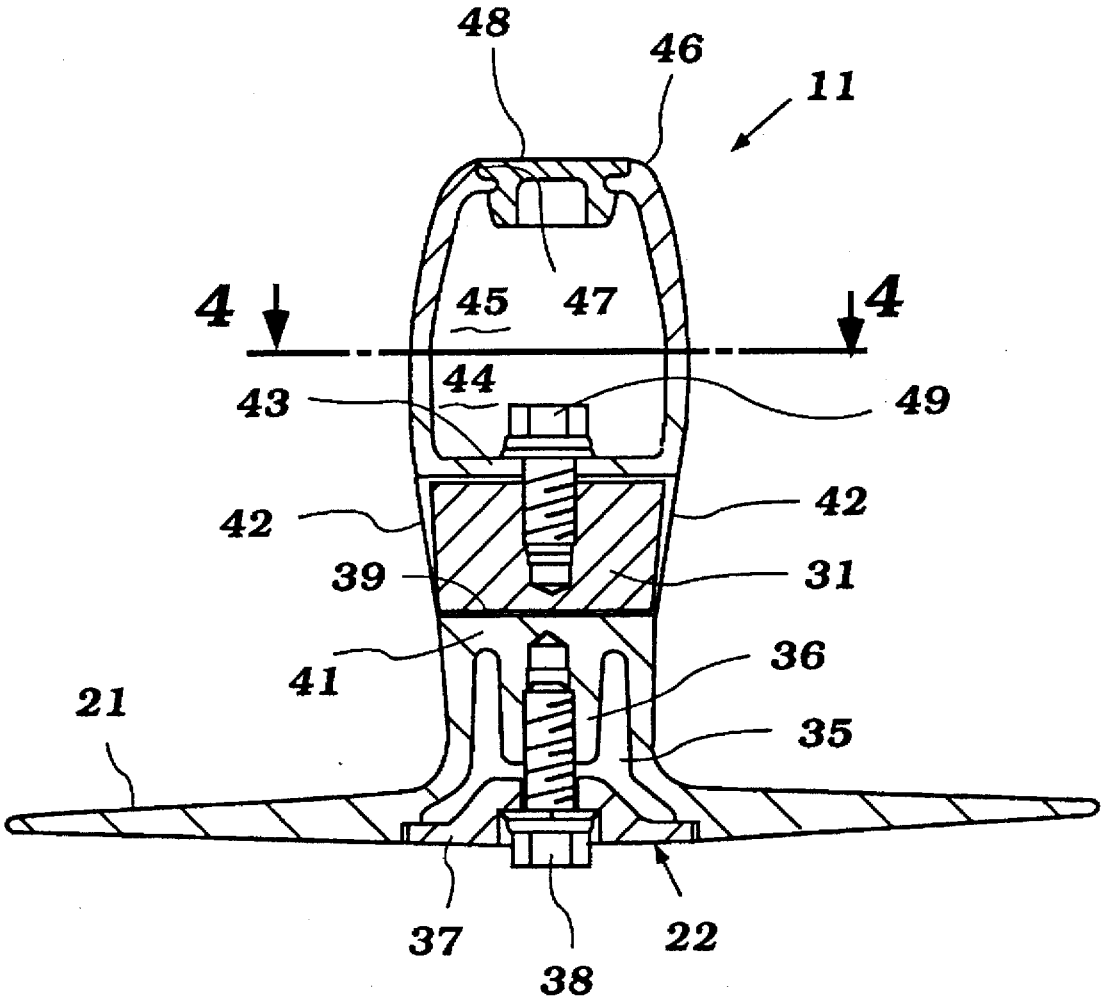
FIG. 3 is a cross-sectional view taken along the line 3—3 of FIG. 2.
Figure 4:
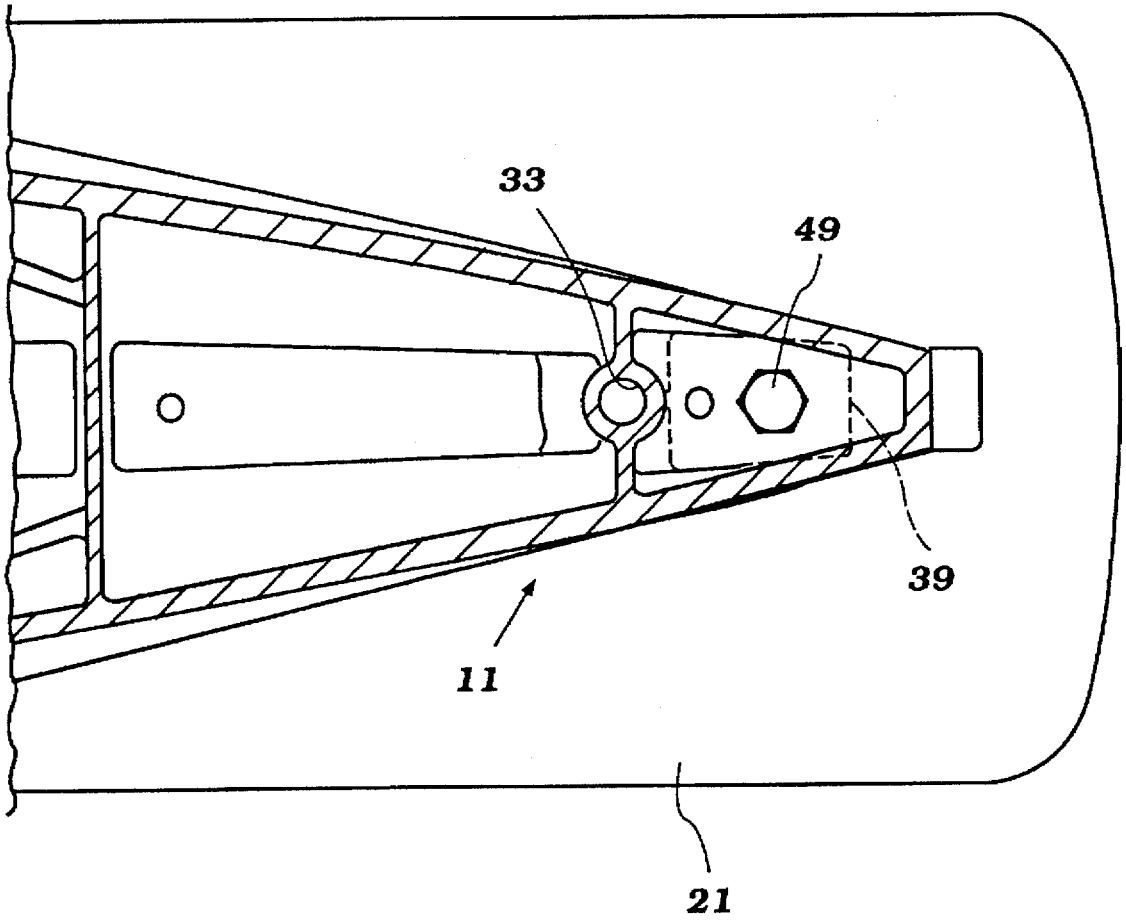
FIG. 4 is a cross-sectional view taken along the line 4—4 of FIG. 3.

A first embodiment of this construction will be described now by continuing reference to this embodiment and by particular reference to FIGS. 2 through 4.

Figure 2:
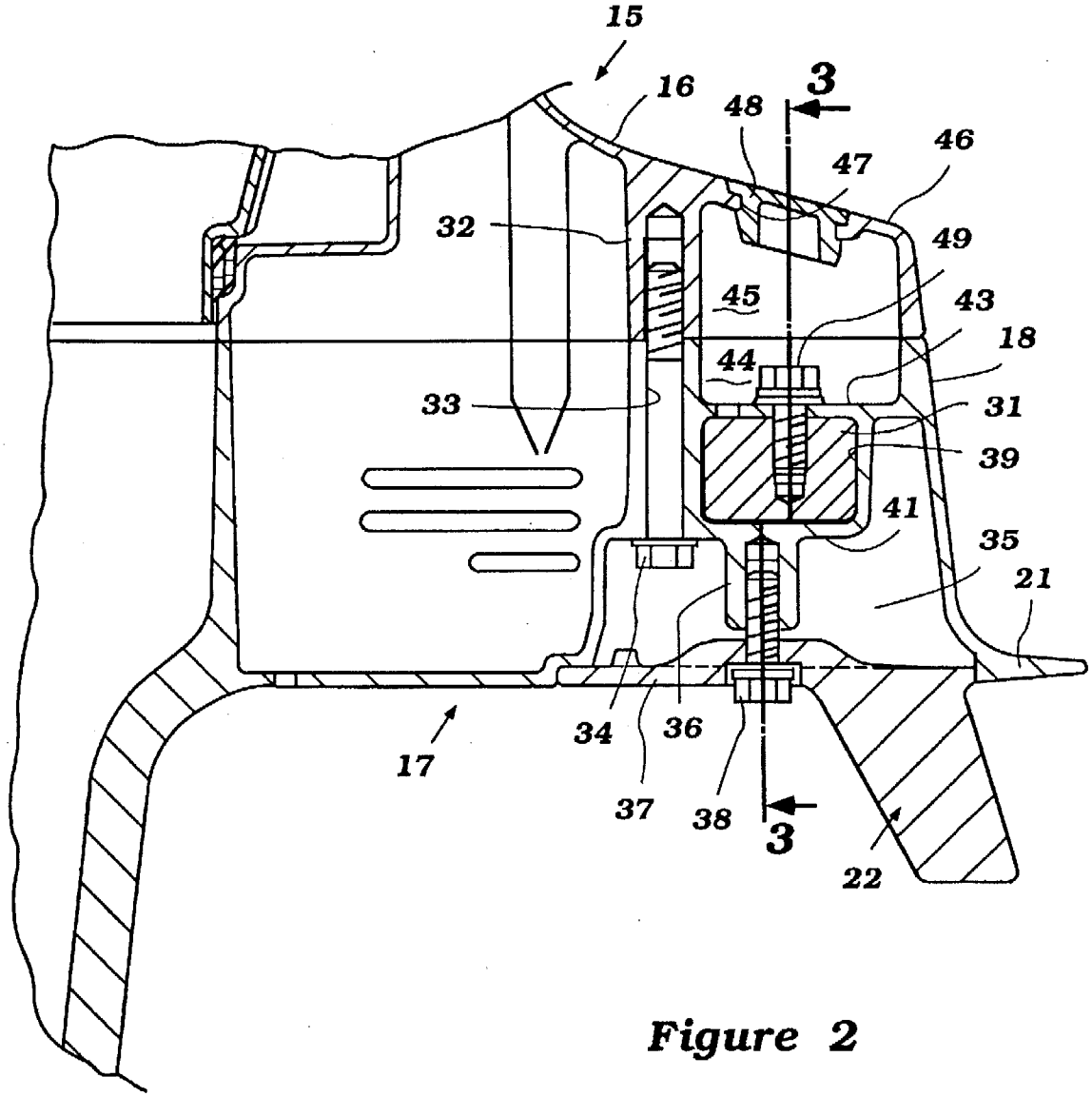
FIG. 2 is an enlarged cross-sectional view of the lower unit portion showing the trim tab, sacrificial anode and attachment therebetween.

Referring first to FIG. 2, the manner of attachment of the lower unit 17 and specifically its casing 18 to the drive shaft housing 15 will be described. It should be noted that the drive shaft housing outer casing 16 has a plurality of downwardly extending projections 32, only one of which appears in the figures. In a similar manner, the outer casing 18 of the lower unit has a plurality of bosses that are formed with bores 33 that aligned with the projections 32. The projections 32 are formed with tapped openings. Threaded fasteners 34 are passed through openings formed by an open lower cavity 35 of the lower unit casing 18 so as to fix these components together.

In a similar manner, the lower unit casing 18 has bosses 36 with tapped openings to which a flange 37 of the trim tab 22 is attached by fasteners 38. This permits adjustment in the angular position of the trim tab.

The lower unit casing 18 is provided with a transversely extending opening 39 which is defined in part by a lower wall 41 from which the boss 36 extends. The sacrificial anode 31 is received in this opening. This exposes the opposite faces of the anode 31 directly to the body of water in which the watercraft is operating through the end openings 42 thereof.

The opening 39 is further defined by a horizontally extending wall 43 of the lower unit casing 18 which lies below a cavity 44. The cavity 44, in turn, mates with a cavity 45 formed in the drive shaft housing outer casing 16. A substantially horizontally disposed surface 46 of the drive shaft housing outer casing 16 overlies this cavity 45 and is provided with an opening 47 in which a removable closure plug 48 is detachably positioned. The closure plug 48 is formed from an elastic material and may be easily inserted and removed so as to access the cavities 45 and 46.

The sacrificial anode 31 is formed with a tapped opening through which a threaded fastener 49 extends with the head of the threaded fastener engaging the surface 45 so as to rigidly affix the sacrificial anode 31 in the opening 39. As should be readily apparent, the sacrificial anode 31 may be easily removed on tilting the outboard motor up by removal of the plug 48 and unscrewing of the fastener 49. Hence, this attachment is from above and also the threaded fastener is not exposed so that it will offer any drag to the operation of the outboard motor as it passes through the body of water and propelling the watercraft.

Figure 5:
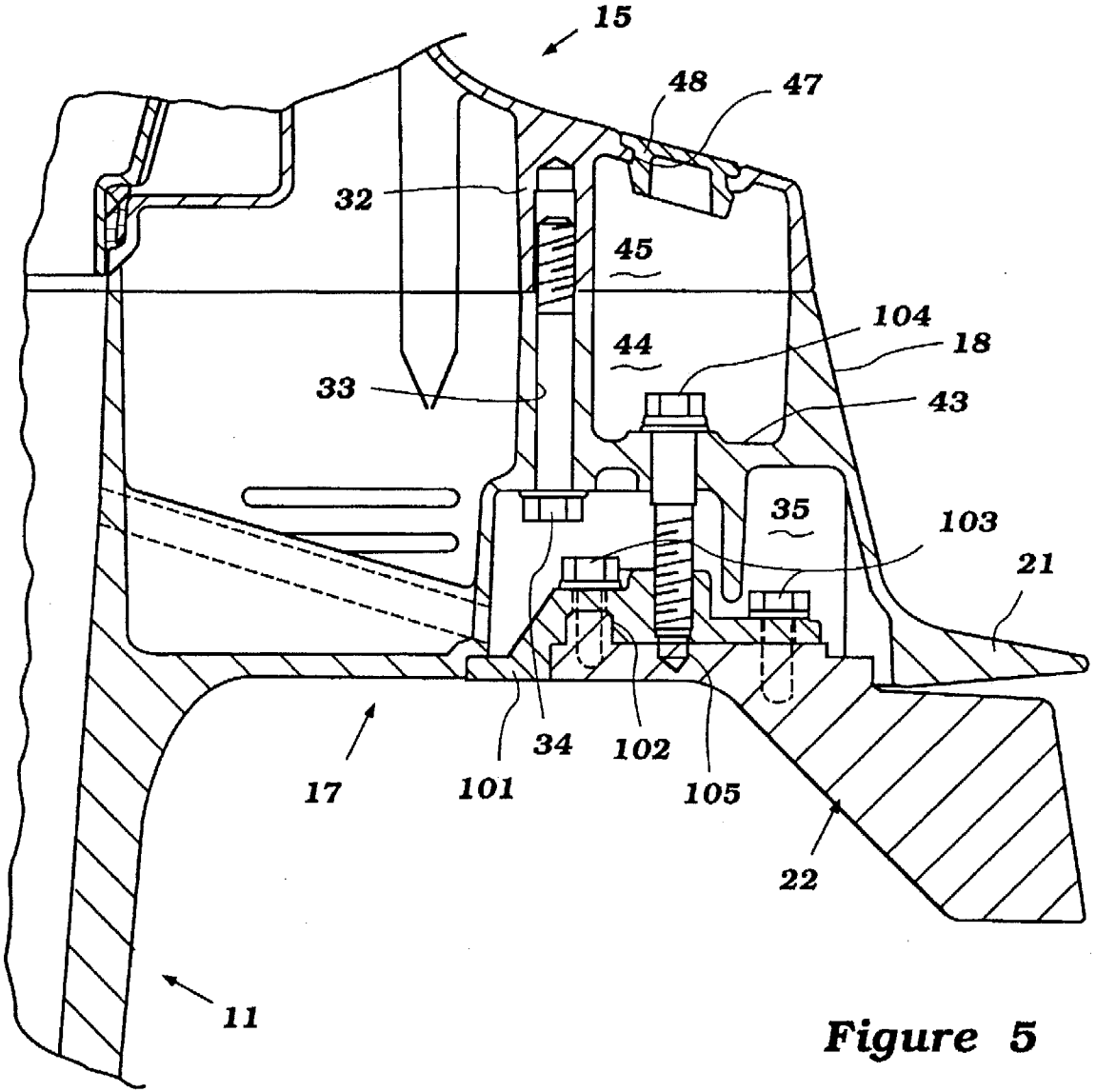
FIG. 5 is a cross-sectional view, in part similar to FIG. 2, and shows another embodiment of the invention.

FIG. 5 shows another embodiment of the invention which is generally the same as the embodiment previously described and, for that reason, where components are the same or substantially the same, they have been identified by the same referenced numerals. This embodiment is of a type wherein the lower unit 17 and specifically its outer casing 18 may be more readily replaced to accommodate larger propulsion units and wherein the trim tab, again indicated by the reference numeral 42, is detachably connected to the sacrificial anode, indicated by the reference numeral 101 in this figure. Also, this construction avoids the necessity for having the separate opening 39 in the lower unit casing 18. In this embodiment, the sacrificial anode 101 has a recess in which a projection 102 of the trim tab 22 is received so as to non-rotatably connect these two elements. Threaded fasteners 103 are threaded through the sacrificial anode 101 and into tapped openings in the trim tab 22 to complete the attachment. It should be noted, the connection permits a portion of the sacrificial anode 101 to directly contact the body of water and, hence, water can fill the cavity 35 in this embodiment.

A threaded fastener 104 passes through the wall 43 at the lower end of the cavity 44 and is tapped into a tapped opening formed in the sacrificial anode 101. A drilled portion 105 is formed in the trim tab 22 so as to clear the end of the fastener 104, but there is no threaded connection in this area. Hence, the trim tab 22 is connected to the anode 101 and the anode 101 is connected to the lower unit casing 18. Thus, with this embodiment, the trim tab 22 and anode 101 may both be removed by removal of the fastener 104. Again, this removal is from above and, thus, no fastener is protruded into the water stream.

It should be readily apparent from the foregoing description that the described embodiments of the invention well fulfill the objects set out above. Of course, it would be readily apparent to those skilled in the art the foregoing descriptions are those of preferred embodiments and various changes and modifications may be made without departing from the spirit and scope of the invention, as defined by the appended claims.

I claim:

1. A lower unit and sacrificial anode arrangement for a marine propulsion unit having an outer housing portion for operating below the water level, said outer housing portion providing a trim tab depending therefrom, a sacrificial anode juxtaposed to said trim tab, and threaded fastening means accessible from the area of said outer housing portion above said trim tab for detachably connecting said sacrificial anode to said outer housing portion.

2. A lower unit and sacrificial anode arrangement for a marine propulsion unit as set forth in claim 1, wherein the threaded fastening means extends about a generally vertically extending axis in the normal position of the marine propulsion unit.

3. A lower unit and sacrificial anode arrangement for a marine propulsion unit as set forth in claim 2, wherein the threaded fastening means has a head portion disposed at the upper end thereof.

4. A lower unit and sacrificial anode arrangement for a marine propulsion unit as set forth in claim 3, wherein the outer housing portion is formed with a recess in which the threaded fastening means is contained so that the threaded fastening means is not exposed to the water flowing past the outer housing portion.

5. A lower unit and sacrificial anode arrangement for a marine propulsion unit as set forth in claim 4, wherein the recess of the outer housing portion is bounded on its upper surface by an opening formed in an upper wall of the outer housing portion and further including a removable closure plug for removably closing said opening and by which the threaded means may be accessed upon removal thereof.

6. A lower unit and sacrificial anode arrangement for a marine propulsion unit as set forth in claim 1, wherein the sacrificial anode is detachably connected to the outer housing portion independently of the trim tab.

7. A lower unit and sacrificial anode arrangement for a marine propulsion unit as set forth in claim 6, wherein the threaded fastening means extends about a generally vertically extending axis in the normal position of the marine propulsion unit.

8. A lower unit and sacrificial anode arrangement for a marine propulsion unit as set forth in claim 7, wherein the threaded fastening means has a head portion disposed at the upper end thereof.

9. A lower unit and sacrificial anode arrangement for a marine propulsion unit as set forth in claim 8, wherein the outer housing portion is formed with a recess in which the threaded fastening means is contained so that the threaded fastening means is not exposed to the water flowing past the outer housing portion.

10. A lower unit and sacrificial anode arrangement for a marine propulsion unit as set forth in claim 9, wherein the recess of the outer housing portion is bounded on its upper surface by an opening formed in an upper wall of the outer housing portion and further including a removable closure plug for removably closing said opening and by which the threaded means may be accessed upon removal thereof.

11. A lower unit and sacrificial anode arrangement for a marine propulsion unit as set forth in claim 1, wherein the trim tab is detachably connected to the sacrificial anode and is affixed to the outer housing portion by the threaded fastening means that affix the sacrificial anode to the outer housing portion.

12. A lower unit and sacrificial anode arrangement for a marine propulsion unit as set forth in claim 11, wherein the trim tab is formed by a piece separate from the sacrificial anode.

13. A lower unit and sacrificial anode arrangement for a marine propulsion unit as set forth in claim 12, wherein the threaded fastening means that affix the trim tab to the sacrificial anode are disposed outside of the water stream and within a recess in the outer housing portion into which the sacrificial anode extends.

14. A lower unit and sacrificial anode arrangement for a marine propulsion unit as set forth in claim 13, wherein the threaded fastening means extends about a generally vertically extending axis in the normal position of the marine propulsion unit.

15. A lower unit and sacrificial anode arrangement for a marine propulsion unit as set forth in claim 14, wherein the threaded fastening means has a head portion disposed at the upper end thereof.

16. A lower unit and sacrificial anode arrangement for a marine propulsion unit as set forth in claim 15, wherein the outer housing portion is formed with a recess in which the threaded fastening means is contained so that the threaded fastening means is not exposed to the water flowing past the outer housing portion.

17. A lower unit and sacrificial anode arrangement for a marine propulsion unit as set forth in claim 15, wherein the recess of the outer housing portion is bounded on its upper surface by an opening formed in an upper wall of the outer housing portion and further including a removable closure plug for removably closing said opening and by which the threaded means may be accessed upon removal thereof.

* * * * *